US007263793B1

(12) United States Patent
Van't Hof

(10) Patent No.: US 7,263,793 B1
(45) Date of Patent: Sep. 4, 2007

(54) EMERGENCY INFORMATION STORAGE ASSEMBLY AND METHOD

(76) Inventor: Christian J. Van't Hof, 5315 Stuart Ave. South East, Kentwood, MI (US) 49508

( * ) Notice: Subject to any disclaimer, the term of this patent is extended or adjusted under 35 U.S.C. 154(b) by 311 days.

(21) Appl. No.: 11/140,041

(22) Filed: May 31, 2005

(51) Int. Cl.
*G09F 7/00* (2006.01)

(52) U.S. Cl. ..... 40/584; 220/476; 220/4.28

(58) Field of Classification Search ..... 40/584, 40/566, 606.06; 232/19, 38; D20/17; 206/803; 220/476, 4.28
See application file for complete search history.

(56) References Cited

U.S. PATENT DOCUMENTS

| | | | | | |
|---|---|---|---|---|---|
| 2,452,667 | A | * | 11/1948 | Lambert | 40/566 |
| D215,534 | S | * | 10/1969 | Rossi | D20/17 |
| 4,289,238 | A | * | 9/1981 | Warncke et al. | 206/527 |
| 5,522,540 | A | * | 6/1996 | Surman | 232/17 |
| D377,809 | S | | 2/1997 | DiMarco, Sr. et al. | |
| 5,832,642 | A | | 11/1998 | Dalton | |
| 5,845,843 | A | * | 12/1998 | Kuller | 232/38 |
| 6,032,855 | A | * | 3/2000 | Douglas | 232/17 |
| 6,520,367 | B1 | * | 2/2003 | Piroch | 220/483 |
| 6,668,476 | B1 | | 12/2003 | Gaines et al. | |
| 6,719,193 | B2 | | 4/2004 | Katulka | |
| 2002/0129524 | A1 | | 9/2002 | Haines | |
| 2002/0166272 | A1 | | 11/2002 | Gaymon | |
| 2002/0179609 | A1 | * | 12/2002 | Cohen | 220/528 |
| 2005/0006274 | A1 | * | 1/2005 | Cox | 206/569 |
| 2005/0194391 | A1 | * | 9/2005 | Domke et al. | 220/835 |
| 2005/0224387 | A1 | * | 10/2005 | Desjardins et al. | 206/527 |
| 2006/0201940 | A1 | * | 9/2006 | Morrison | 220/4.21 |

* cited by examiner

*Primary Examiner*—William L. Miller

(57) ABSTRACT

An emergency information storage assembly includes a housing that has a back wall, a front wall and a peripheral wall extending between and is attached to the front and back walls. The peripheral wall has a peripheral break therein so that a first portion of the housing selectively separable from a second portion of the housing. A panel has a size and shape configured to be selectively positioned in the housing. A wall surface has a doorway extending therethrough. The housing is positioned adjacent to the doorway and a plurality of fasteners is extended through the back wall and into the wall surface so that the back wall is attached to the wall surface. Personal emergency information is placed on the panel and the panel is position in the housing so that emergency personnel may retrieve it.

8 Claims, 2 Drawing Sheets

EMERGENCY INFORMATION STORAGE ASSEMBLY AND METHOD

BACKGROUND OF THE INVENTION

1. Field of the Invention

The present invention relates to emergency information storage devices and more particularly pertains to a new emergency information storage device for storing information in a manner that may be readily accessible by emergency personnel. Additionally, the device serves a second purpose as a house address sign, which will ensure that the emergency personnel easily find it.

2. Description of the Prior Art

The use of house address number signs, which can contain information is known in the prior art. U.S. Patent Appl. No. 2002/0166272 describes a housing that may hold one of a plurality of address signs which are held in slots in the housing and which may be viewed through a window in the housing. A mailbox housing having means for holding address information is shown in U.S. Pat. No. 6,719,193. A similar type of device is found in U.S. Patent Appl. No. 2002/0129524, which includes signage that is interchangeable and which is attachable to a dwelling or to a mailbox.

While these devices fulfill their respective, particular objectives and requirements, the need remains for a method of storing emergency information of persons within a dwelling in such a manner that the information is readily accessible to emergency personnel.

SUMMARY OF THE INVENTION

The present invention meets the needs presented above by generally comprising a housing that has a back wall, a front wall and a peripheral wall extending between and is attached to the front and back walls. The peripheral wall has a peripheral break therein so that a first portion of the housing including the back wall is selectively separable from a second portion of the housing including the front wall. A pair of complimentary engaging members is attached to a respective one of the first and second portions to releasably secure the first portion to the second portion. A panel has a size and shape configured to be selectively positioned in the housing. A wall surface has a doorway extending therethrough. The housing is positioned adjacent to the doorway and a plurality of fasteners is extended through the back wall and into the wall surface so that the back wall is attached to the wall surface. Personal emergency information is placed on the panel and the panel is position in the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
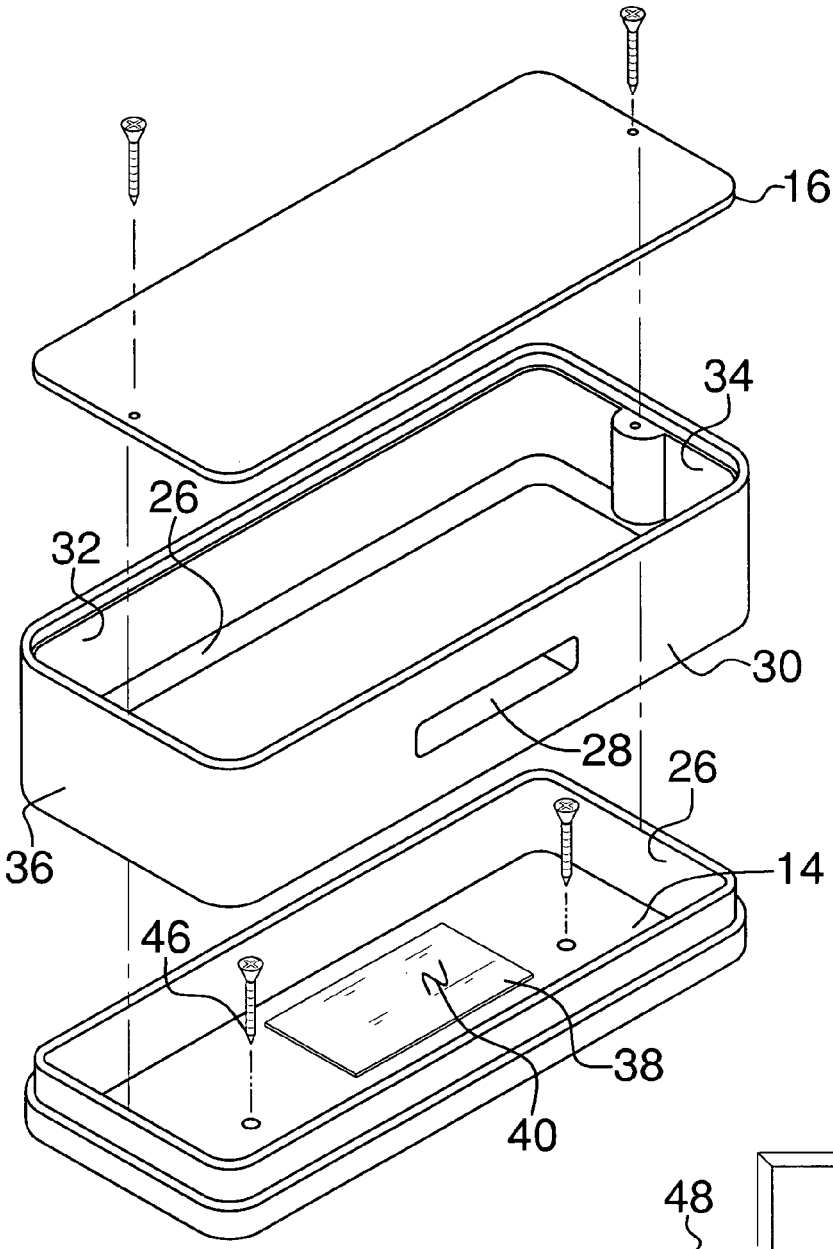
FIG. 1 is an expanded perspective view of a emergency information storage assembly and method according to the present invention.
Figure 2:
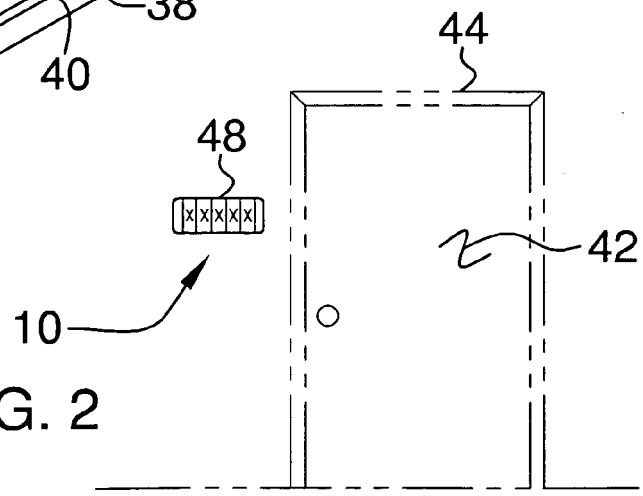
FIG. 2 is a front in-use view of the present invention.
Figure 3:
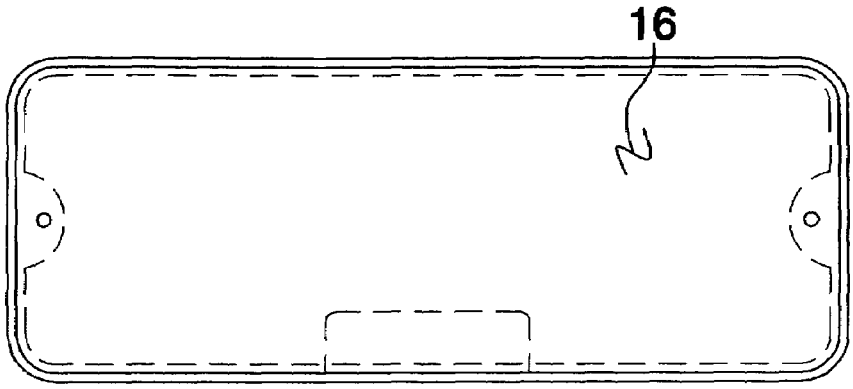
FIG. 3 is a front view of the present invention.
Figure 4:
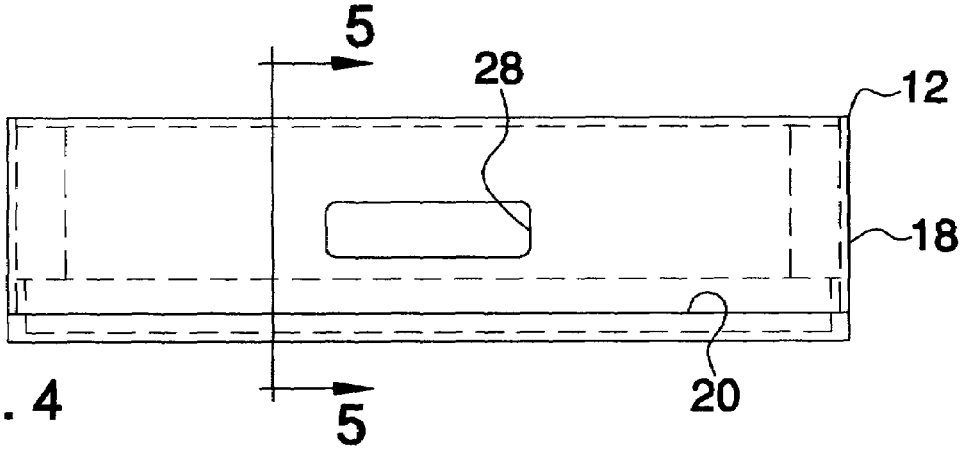
FIG. 4 is a top view of the present invention.
Figure 5:
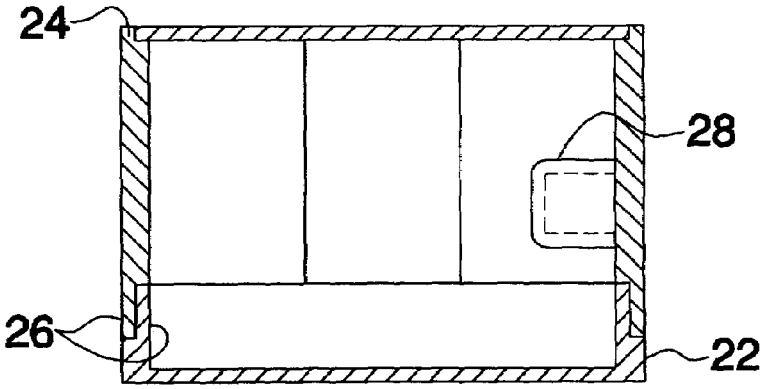
FIG. 5 is a cross-sectional view taken along line 5-5 of FIG. 4 of the present invention.

With reference now to the drawings, and in particular to FIGS. 1 through 5 thereof, a new emergency information storage device embodying the principles and concepts of the present invention and generally designated by the reference numeral 10 will be described.

As best illustrated in FIGS. 1 through 5, the emergency information storage assembly and method 10 generally comprises a housing 12 that has a back wall 14, a front wall 16 and a peripheral wall 18 that extends between and is attached to the front 16 and back 14 walls. The peripheral wall 18 has a peripheral break 20 therein so that a first portion 22 of the housing 12 including the back wall 14 is selectively separable from a second portion 24 of the housing 12 including the front wall 16. A pair of complimentary engaging members 26 is attached to a respective one of the first 22 and second 24 portions to releasably secure the first portion 22 to the second portion 24.

The peripheral wall 12 has an indentation therein 28. The indentation 28 defines a handle grip. The peripheral wall 12 includes a top wall 30, a bottom wall 32, a first side wall 34 and a second side wall 36. The indentation 28 is in the top wall 30. The housing 12 has a width from the first side wall 34 to the second side wall 36 generally between 10 inches and 16 inches, a height from the bottom wall 32 to the top wall 30 generally between 3 inches and 6 inches and a depth from the front wall 16 to the back wall 12 generally between 1 inch and 3 inches. The housing 12 is constructed out of a rigid material that may include a plastic, wood or metallic material.

A panel 38 is provided which has a size and shape configured to be selectively positioned in the housing 12. The panel 38 may be comprised of any suitable material used for an information card, such as a paper material. A person places their personal emergency information 40 on the panel 38. This may include any particular illnesses or medications, as well as the names, ages and number of persons living at a particular dwelling.

A wall surface 42 is provided and includes a doorway 44 that is extending through the wall surface 42. The housing 12 is positioned adjacent to the doorway 44 and a plurality of fasteners 46 is extended through the back wall 14 and into the wall surface 42 so that the back wall 14 is attached to the wall surface 42. The panel 38 is then positioned in the housing and the first 22 and second 24 portions joined so that the panel 38 is retained within the housing 12. Address number indicia 48 are preferably positioned on an outer surface of the front wall 16. This allows the housing 12 to also be used as signage for displaying a house address. During an emergency, rescue workers can remove the second portion 24 from the first portion 22 to retrieve the panel 38 inside. This will provide them with the number of people within a house as well as inform them of any special medical needs of the people within the house.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of storing emergency information comprising the steps of:

providing a housing having a back wall, a front wall and a peripheral wall extending between and being attached to said front and back walls, said peripheral wall having a peripheral break therein such that a first portion of said housing including said back wall is selectively separable from a second portion of said housing including said front wall, a pair of complimentary engaging members being attached to a respective one of said first and second portions to releasably secure said first portion to said second portion;

providing a panel having a size and shape configured to being selectively positioned in said housing;

providing a wall surface having a doorway extending therethrough;

positioning said housing adjacent to said doorway and extending a plurality of fasteners through said back wall and into said wall surface such that said back wall is attached to said wall surface;

positioning personal emergency information on said panel; and positioning said panel in said housing.

2. The method according to claim 1, wherein said peripheral wall has an indentation therein, said indentation defining a handle grip.

3. The method according to claim 2, wherein said peripheral wall includes a top wall, a bottom wall, a first side wall and a second side wall, said indentation being in said top wall.

4. The method according to claim 2, further including providing address number indicia being attached to and being positioned on an outer surface of said front wall.

5. The method according to claim 1, wherein said peripheral wall includes a top wall, a bottom wall, a first side wall and a second side wall.

6. The method according to claims 5 or 3, wherein said housing has a width from said first side wall to said second side wall generally between 10 inches and 16 inches, a height from said bottom wall to said top wall generally between 3 inches and 6 inches and a depth from said front wall to said back wall generally between 1 inch and 3 inches.

7. The method according to claim 1, further including providing address number indicia being attached to and being positioned on an outer surface of said front wall.

8. A method of storing emergency information comprising the steps of:

providing a housing having a back wall, a front wall and a peripheral wall extending between and being attached to said front and back walls, said peripheral wall having a peripheral break therein such that a first portion of said housing including said back wall is selectively separable from a second portion of said housing including said front wall, a pair of complimentary engaging members being attached to a respective one of said first and second portions to releasably secure said first portion to said second portion, said peripheral wall having an indentation therein, said indentation defining a handle grip, said peripheral wall including a top wall, a bottom wall, a first side wall and a second side wall, said indentation being in said top wall, said housing having a width from said first side wall to said second side wall generally between 10 inches and 16 inches, a height from said bottom wall to said top wall generally between 3 inches and 6 inches and a depth from said front wall to said back wall generally between 1 inch and 3 inches;

providing a panel having a size and shape configured to being selectively positioned in said housing;

providing a wall surface having a doorway extending therethrough;

positioning said housing adjacent to said doorway and extending a plurality of fasteners through said back wall and into said wall surface such that said back wall is attached to said wall surface;

positioning personal emergency information on said panel;

positioning said panel in said housing; and providing address number indicia being attached to and being positioned on an outer surface of said front wall.

* * * * *